United States Patent [19]

Kikuno

[11] Patent Number: 4,627,715

[45] Date of Patent: Dec. 9, 1986

[54] PROGRAMMABLE COPIER

[75] Inventor: Mitsutoyo Kikuno, Machida, Japan

[73] Assignee: Ricoh Company, Ltd., Japan

[21] Appl. No.: 645,916

[22] Filed: Aug. 29, 1984

[30] Foreign Application Priority Data

Aug. 31, 1983 [JP] Japan ..... 58-157904
Sep. 21, 1983 [JP] Japan ..... 58-173245

[51] Int. Cl.[4] ..... G03G 21/00; G03G 15/00
[52] U.S. Cl. ..... 355/14 R; 355/3 R
[58] Field of Search ..... 355/3 R, 14 R, 14 D, 355/14 SH, 14 C

[56] References Cited

U.S. PATENT DOCUMENTS 3,970,384 7/1976 Yamamoto et al. ..... 355/14 SH
4,101,214 7/1978 Irie et al. ..... 355/14 D X
4,503,960 3/1985 Koeleman et al. ..... 355/14 SH X

*Primary Examiner*—Fred L. Braun
*Attorney, Agent, or Firm*—Guy W. Shoup

[57] ABSTRACT

A programmable copier capable of making copies from a plurality of originals from which one or more copies are to be made in accordance with copy information temporarily stored in a memory is provided. The copier is provided with a CPU for checking as to whether the total number of copies to be made for the next copy job when added to the total number of copies thus far stored exceeds the maximum number of copies producible from the remaining amount of toner or copy paper, and, if it has been found to be exceeded, that copy job is inhibited from being stored and a warning signal to that effect is indicated.

4 Claims, 9 Drawing Figures

PROGRAMMABLE COPIER

BACKGROUND OF THE INVENTION

1. Field of the Invention

This invention relates to a copier capable of temporarily storing information, such as the number of originals from which one or more copies are to be made and the number of copies to be made from each of the originals, and making copies automatically in accordance with the information stored. More particularly, the present invention relates to a programmable copier capable of providing a warning signal when the current condition, such as the remaining amount of toner and number of copy sheets, is exceeded by the operating condition set by an operator.

2. Description of the Prior Art

A programmable copier, which temporarily stores information, such as the number of originals from which one or more copies are to be made and the number of copies to be made from each of the originals, is well known in the art. In such a prior art programmable copier, however, since the copying conditions programmed by an operator are not examined in relation to the current status of the copier, such as the remaining amount of toner and copy sheets, the copier may come to a halt accidentally due, for example, to shortage of toner and/or copy sheets. When such an accidental halt occurs, the operator must examine the quality of the copies made and resume the intended copy operation after replenishment of depleted items.

SUMMARY OF THE INVENTION

It is therefore a primary object of the present invention to obviate the disadvantages of the prior art as described above and to provide an improved programmable copier.

Another object of the present invention is to provide a programmable copier capable of examining copying conditions set by an operator in relation to the current status of the copier thereby giving a warning signal when the set conditions are found to be excessive.

A further object of the present invention is to provide a programmable copier capable of carrying out a copying operation automatically in accordance with copying conditions previously set by an operator at all times without failure or interruption.

A still further object of the present invention is to provide a programmable copier easy to operate and reliable in operation.

A still further object of the present invention is to provide a programmable copier capable of giving a warning signal when the remaining amount of toner is found to be insufficient in making all of the copies set by an operator.

A still further object of the present invention is to provide a programmable copier capable of giving a warning signal when the remaining amount of copy sheets is found to be insufficient in making all of the copies set by an operator.

A still further object of the present invention is to provide a programmable copier which permits an operator to engage in some other tasks during a copying operation implemented according to the information temporarily stored as set by the operator.

Other objects, advantages and novel features of the present invention will become apparent from the following detailed description of the invention when considered in conjunction with the accompanying drawings.

DESCRIPTION OF THE PREFERRED EMBODIMENTS

Figure 1:
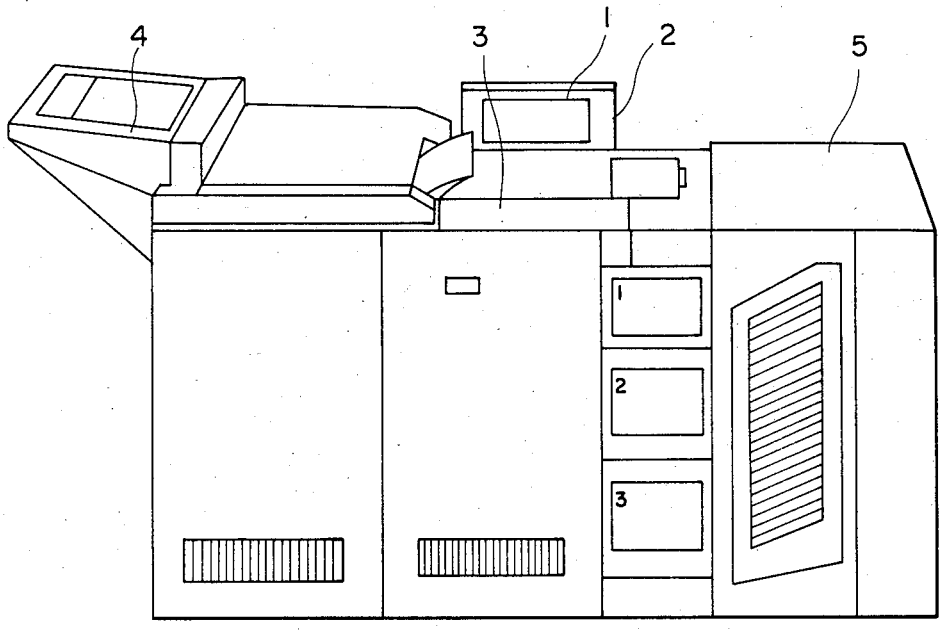
FIG. 1 is a schematic illustration showing the overall outlook of a programmable copier constructed in accordance with one embodiment of the present invention.

Referring now to FIG. 1, there is shown a programmable copier constructed in accordance with one embodiment of the present invention. As is well known for one skilled in the art, such a programmable copier is typically an image transfer type electrophotographic copier using a photosensitive member in the form of a drum or belt. In such a case, typically, the photosensitive member is first uniformly charged to a predetermined polarity, which is then exposed to light containing image information to form an electrostatic latent image. The latent image is then developed thereby being converted into a toner image, which is then transferred to a sheet of transfer paper. The toner image transferred to the transfer paper is fixed thereto; on the other hand, the photosensitive member after image transfer is subjected to cleaning thereby preparing for the next cycle of operation.

Figure 2:
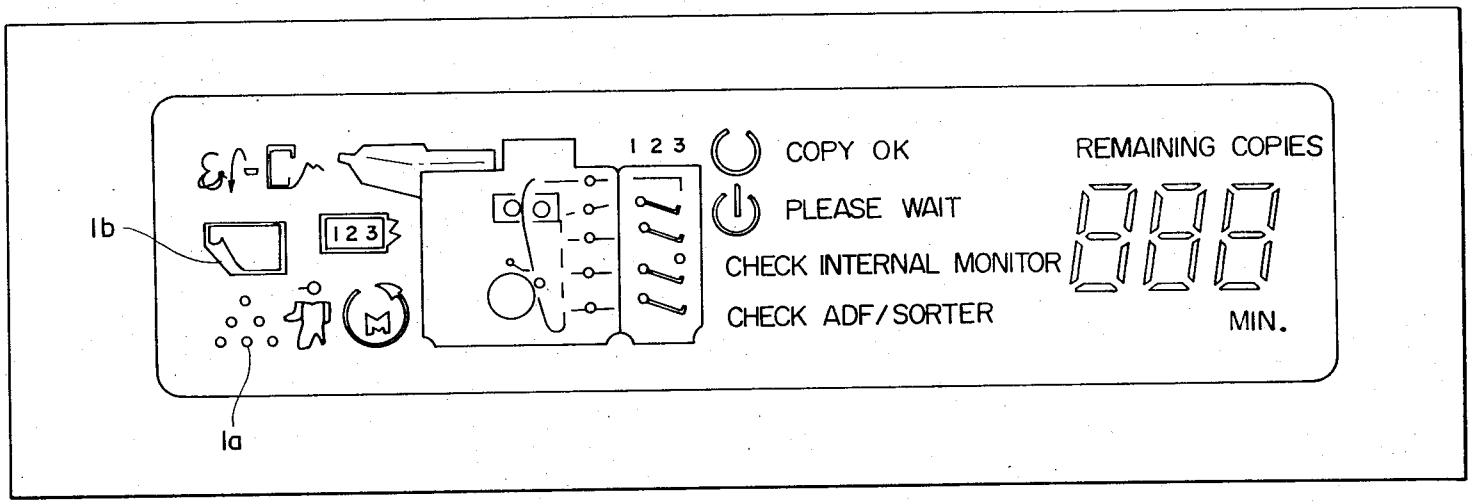
FIG. 2 is a schematic illustration showing on an enlarged scale a display section provided on the copier of FIG. 1.

As shown, the copier includes a display section 1 for displaying various information associated with copying conditions, a copy process control section 2, a control panel 3, an automatic document feeder (ADF) for feeding original documents one by one automatically, and a sorter 5. As shown in FIG. 2, the display section 1 displays various information, including a toner warning signal 1*a* indicating, when lit, that the toner must be replenished and a copy paper warning signal 1*b* indicating, when lit, that the copy paper needs to be replenished. In the preferred embodiment, these warning indicators are lit in red intermittently when the remaining amount of toner and/or copy paper is found to be smaller than a predetermined value, thereby indicating to an operator that an indicated item must be replenished.

Figure 3:
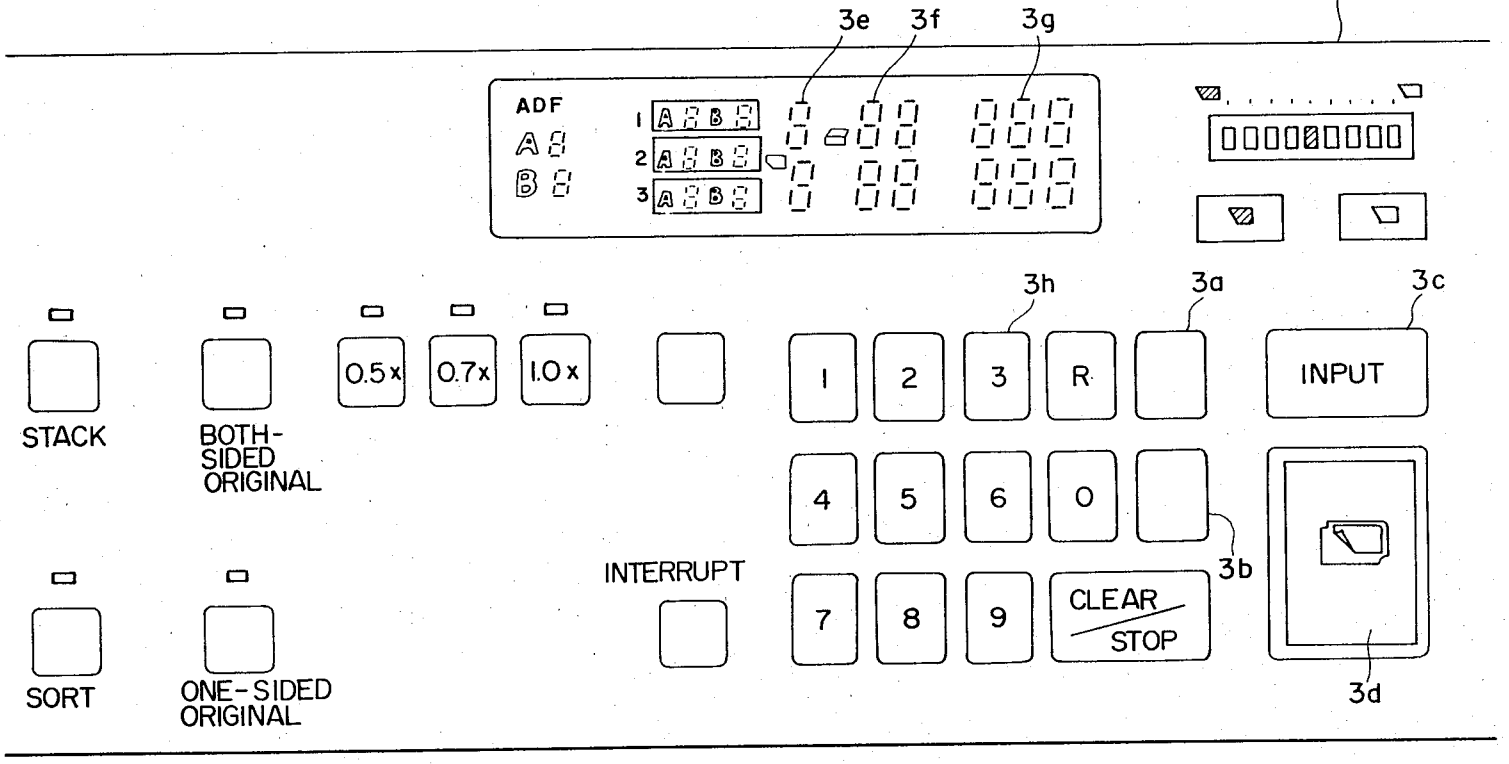
FIG. 3 is a schematic illustration showing on an enlarged scale a control panel provided on the copier of FIG. 1.

As shown in FIG. 3, the control panel 3 includes a number of keys or buttons to be depressed by an operator in setting conditions for carrying out a desired copying operation. Provided in the control panel 3 are a number of originals setting key 3*a*, a number of copies setting key 3*b*, an input key 3*c*, a copy start key 3*d*, a number of copy jobs indicator 3*e*, a number of originals indicator 3*f*, a number of copies indicator 3*g* and a number setting (or numeric) key 3*h*. Various other keys and indicators are also shown, but no detailed description for those will be given partly because they are obvious for one skilled in the art and partly because they do not constitute main elements of the present invention.

Figure 5:
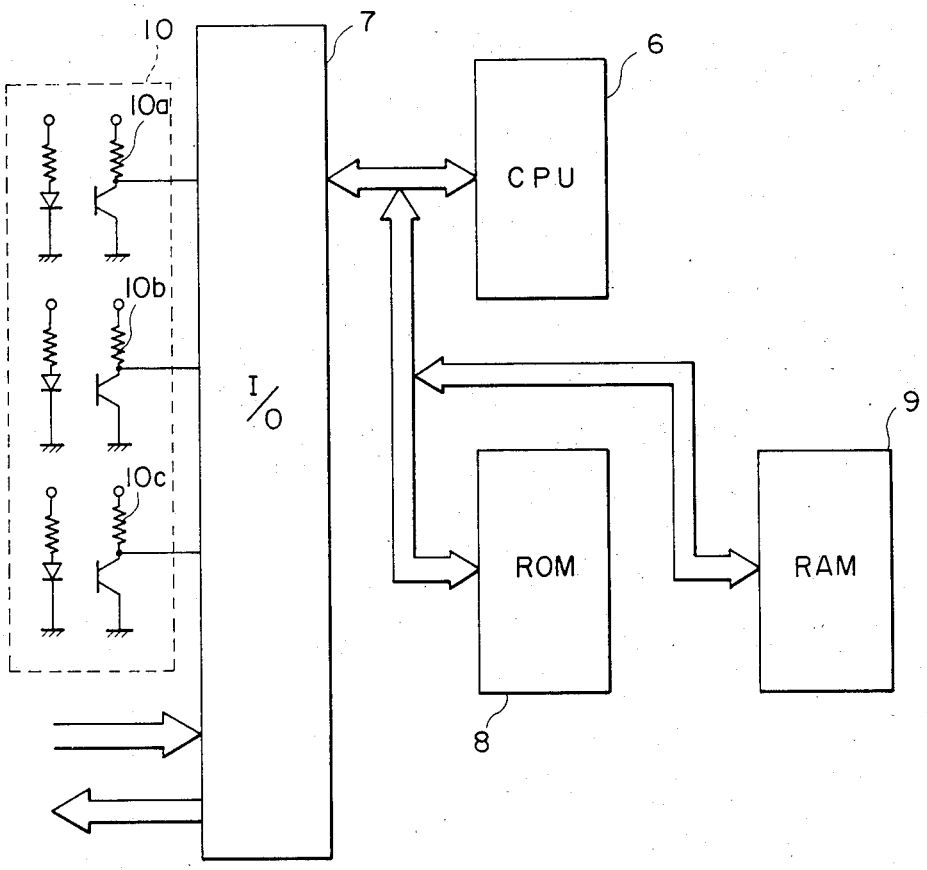
FIG. 5 is a block diagram showing the structure of a control unit provided in the copier of FIG. 1.

FIG. 5 shows the structure in block form of the copy process control section 2, which includes a central processing unit (CPU) 6, an I/O interface unit 7, a read only memory (ROM) 8 and a random access memory (RAM) 9 for storing copy information set by an operator, which are interconnected by buses as shown. I/O interface unit 7 is connected to a toner/copy paper detector 10 for detecting the remaining amount of toner and/or copy paper. In the illustrated embodiment, the toner/copy paper detector 10 is provided with a three sets, 10*a*, 10*b* and 10*c*, of level detectors, each comprised of a light-emitting diode (LED) and a photo-transistor. For example, when the detector 10 is used to detect the remaining amount of toner stored in a container (not shown) provided in the copier, the three sets of these photo-couplers are arranged at different heights along the side wall of the toner container. Under the condition, if the toner is present between the associated LED and photo-transistor, the photo-transistor is rendered off, so that the remaining amount of toner in the container may be monitored depending on which of the photo-couplers at different heights are off. Similarly, the remaining amount of copy sheets stored in the form of a stack may also be detected. By detecting the remaining amount of toner and/or copy paper as described above, the possible maximum number of copies to be made under the current condition can be known. The following table shows one such example.

| 10a | 10b | 10c | Possible Max. No. of Copies |
|---|---|---|---|
| OFF | OFF | OFF | 1,000 |
| ON | OFF | OFF | 500 |
| ON | ON | OFF | 100 |
| ON | ON | ON | 0 |

In the above-described example, if the detector element 10*a* is off, the other detector elements 10*b* and 10*c* are, of course, off, thereby indicating that the remaining amount of toner/copy paper is abundant and copies up to 1,000 can be made continuously under the condition. Similarly, up to 500 copies can be made continuously if the detector element 10*a* is on but the detector element 10*b* is off; furthermore, up to 100 copies can be made without intermission if the detectors 10*a* and 10*b* are on but the detector 10*c* is off. If all of the detector elements 10*a*, 10*b* and 10*c* are on, then the null condition for remaining toner/copy paper is indicated and no copy can be made unless toner/copy paper is suitably replenished.

Figure 6A:
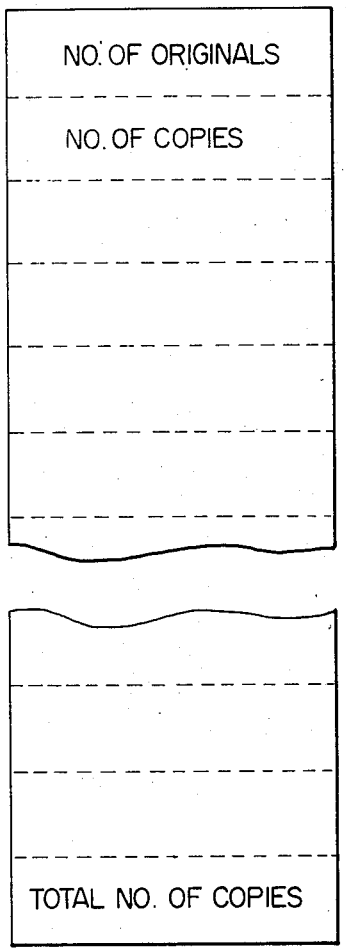
FIGS. 6*a* and 6*b* are schematic illustrations showing memory maps which are useful for explaining the operation of the copier of FIG. 1.
Figure 6B:
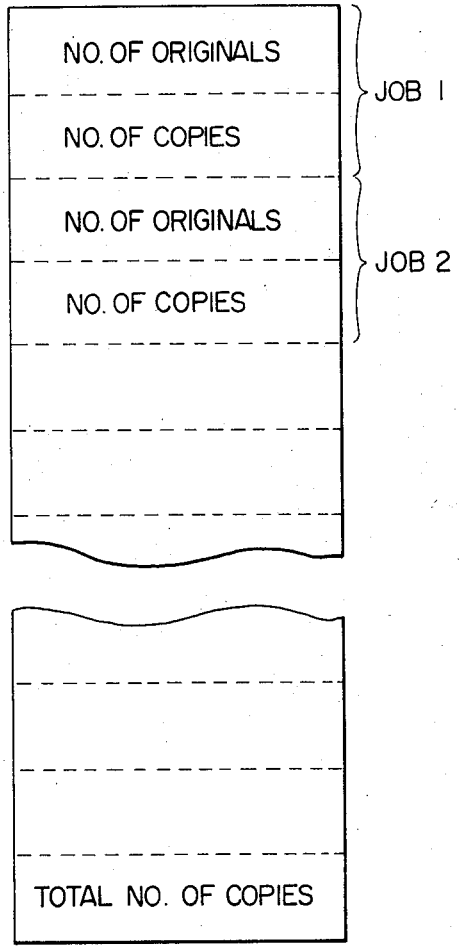

FIGS. 6*a* and 6*b* schematically show memory maps in the RAM 9 in which copy information input by an operator is temporarily stored. FIG. 6*a* shows the contents of a buffer area and FIG. 6*b* shows the contents of a storage area. Of course, the contents of both of these areas become identical eventually. Two copy jobs JOB1 and JOB2 are shown in FIG. 6*b* and each copy job contains a data of number of originals from which one or more copies are to be made and the other data of number of copies to be made.

Figure 7:
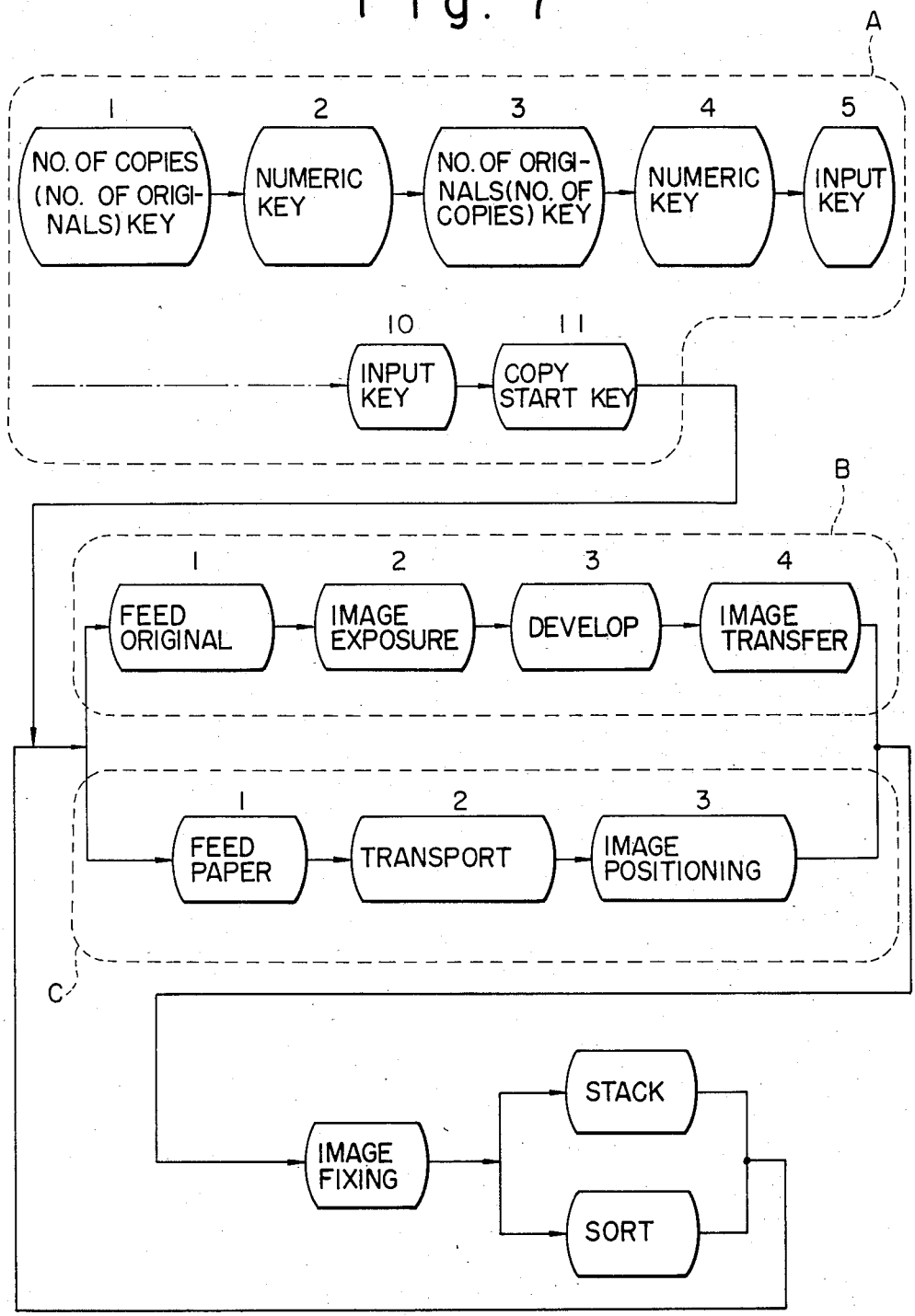
FIG. 7 is a process chart showing the sequence of steps to be followed when an exemplary copying operation is to be carried out with the copier of FIG. 1.

FIG. 7 shows a copy process chart showing the sequence of steps in carrying out a copying operation with the programmable copier shown in FIG. 1. In FIG. 7, the steps enclosed by a dotted loop indicated by A are related to an input process for inputting various information for making copies, the steps enclosed by a dotted loop indicated by B are related to an image forming process and the steps enclosed by a dotted loop indicated by C are related to a paper transporting process. Briefly described along with the process shown in FIG. 7, the desired number of originals from which one or more copies are to be made and the desired number of copies to be made are first set, and the input key and then the copy start key are depressed to initiate the copying operation, which is then repetitively carried out for the number of copy jobs set. In the image forming process, for the originals, the steps of image exposure, developing and image transfer are carried out; on the other hand, for copy paper, the steps of feeding from the stack, transporting and registration are carried out. As a result, there is obtained an image transferred to a sheet of copy paper but not yet fixed thereto. After image transfer, the sheet of copy paper bearing thereon the transferred image is transported past an image fixing unit thereby having the image permanently fixed to the copy paper. Thereafter, the copy paper is transported either to a stacker or to a sorter, as desired.

Figure 4A:
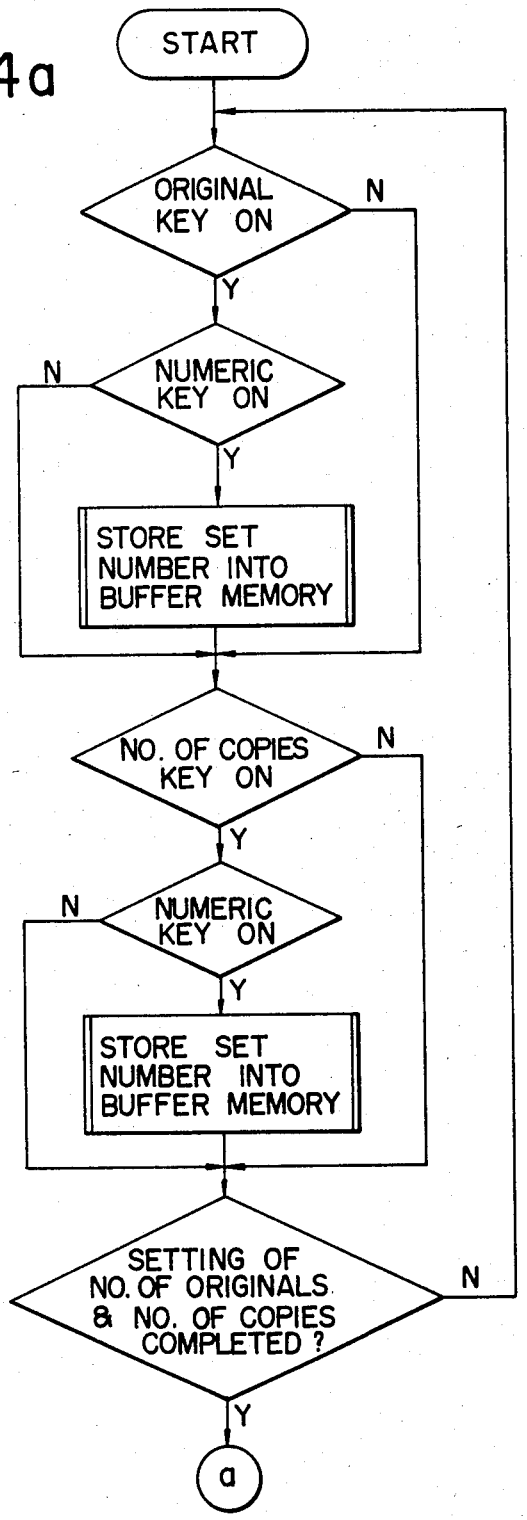
FIGS. 4*a* and 4*b*, when combined, show a flow chart illustrating the sequence of steps to be followed when setting copying conditions with the copier of FIG. 1.
Figure 4B:
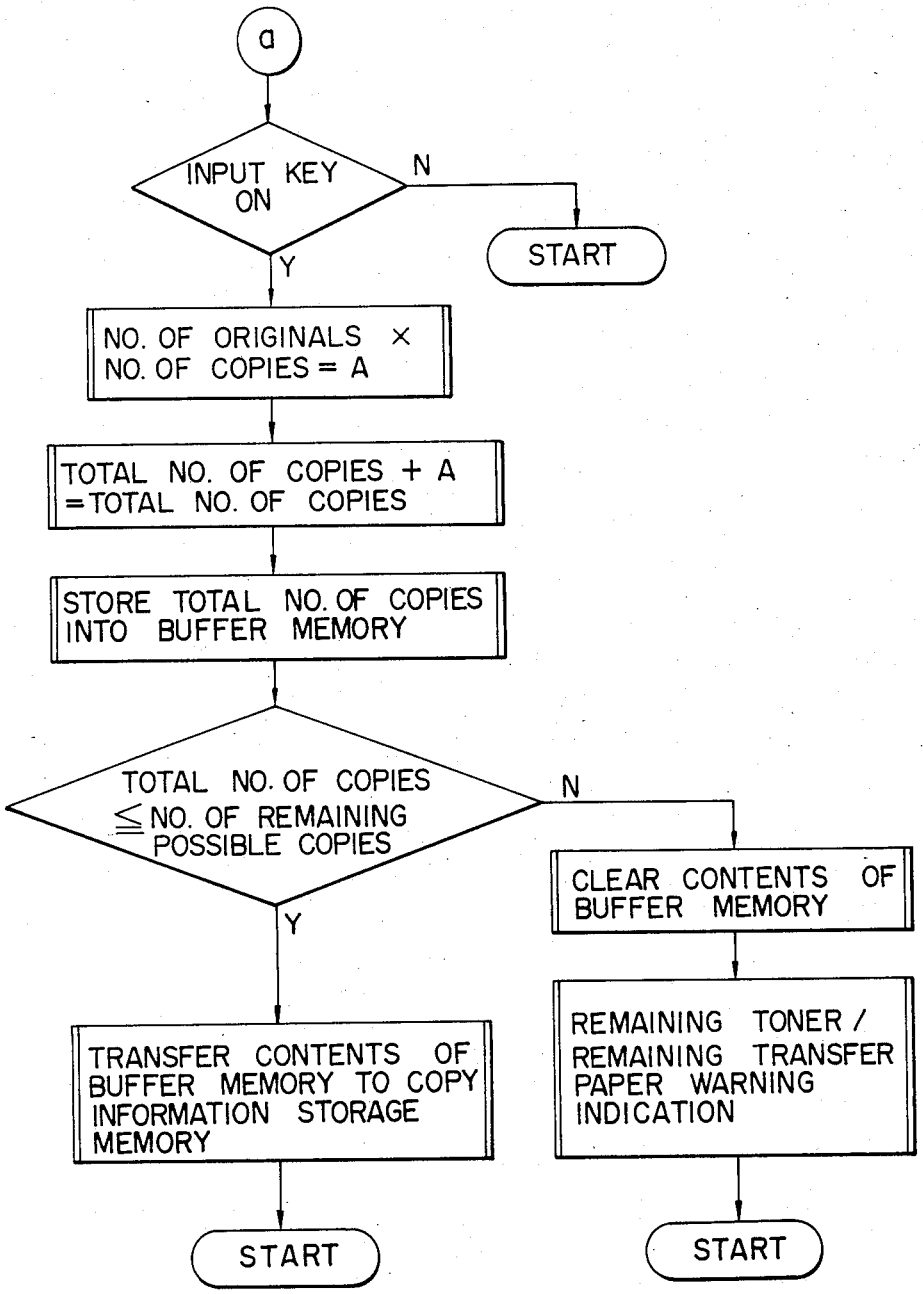

Now, with reference to FIGS. 4 and 7, the control operation of the present invention will be described for a particular case in which two copy jobs are to be carried out: first copy job (JOB1) to make 5 copies for each of 5 originals and second copy job (JOB2) to make 10 copies for each of 20 originals.

In the first place, copy information, or the number of originals and the number of copies, for each copy job must be stored into the memory of the present programmable copier. In this case, as shown in FIG. 7, the number of copies setting key 3*b* is first depressed and then the number of copies to be made is set using the number setting or numeric keys 3*h*. Thereafter, the number of originals setting key 3*a* and numeric keys 3*h* are suitably depressed to set the number of originals from which the number of copies as set are to be made.

The information thus input is indicated at 3*f* and 3*g* in the control panel 3 shown in FIG. 3, and the job number is also indicated at 3*e*. Then, upon depression of the input key 3*c*, the copy information for the first copy job JOB1 is stored into the memory 9. At this stage, however, in accordance with the present invention, the CPU 6 compares the possible max. number of copies, which has been calculated in accordance with a predetermined program stored in the ROM 8 using the data supplied from the detector 10, with the total number of copies of JOB1 ($5\times5=25$). If the CPU 6 finds that the total number of copies of JOB1 is equal to or less than the calculated possible maximum number of copies, then the input information for JOB1 is stored into the memory 9. On the other hand, if the total number of copies of JOB1 is larger, the input information is invalidated and not stored into the memory 9, and, furthermore, either one or both of the warning indicators 1*a* and 1*b* are lit intermittently.

Next, similarly with the previous manner, copy information for the second copy job JOB2 is input. Then, similarly as described above, the input information is examined as to whether the cumulative total number of copies (225), which is a sum of number of copies of JOB1 and number of copies of JOB2, can be produced continuously.

Upon completion of inputting of copy information as described above, a depression of the copy start key 3*d* causes the copy operation to initiate. Once initiated, the copier executes the ordinary copy operation according to the copy control program stored in the ROM 8 as indicated in the process of FIG. 7. In accordance with the present invention, since it is insured that the total number of copies can be produced continuously without intermission once started, the operator is free to do anything else without hesitation while the copy operation is in progress.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. Apparatus for making copies automatically in accordance with temporarily stored copy information, comprising:

input means for inputting said copy information for each copy job, said copy information including at least a number of originals from which one or more copies are to be made and a number of copies to be made from each of said originals;

storing means for storing said copy information job by job;

detecting means for detecting current conditions of said apparatus;

control means for controlling storing of said copy information for each job input by said input means into said storing means such that said copy information for each job is allowed to be stored into said storing means as long as a cumulative total number of copies to be made does not exceed a maximum number of copies obtained from the current conditions detected by said detecting means; and means for making copies in accordance with the copy information stored in said storing means.

2. The apparatus of claim 1 wherein said detecting means includes a toner detector for detecting the remaining amount of toner stored in a reservoir provided in said apparatus and said maximum number of copies is calculated on the basis of the remaining amount of toner detected by said toner detector.

3. The apparatus of claim 1 wherein said detecting means includes a copy paper detector for detecting the remaining amount of copy paper stacked in a storage section provided in said apparatus and said maximum number of copies is calculated on the basis of the remaining amount of copy paper detected by said copy paper detector.

4. The apparatus of claim 1 further comprising indicating means for indicating a warning signal when said control means has found that said cumulative total number of copies has exceeded said maximum number of copies.

* * * * *